United States Patent [19]

Hamel

[11] Patent Number: 4,846,518

[45] Date of Patent: Jul. 11, 1989

[54] GRIPPING DEVICE FOR A DOLL'S EXTREMITY

[75] Inventor: Shelly H. Hamel, Madison, Wis.

[73] Assignee: Pleasant Company, Madison, Wis.

[21] Appl. No.: 96,509

[22] Filed: Sep. 11, 1987

[51] Int. Cl.[4] ..... B25B 3/00

[52] U.S. Cl. ..... 294/99.1; 294/27.1; 446/268

[58] Field of Search ..... 294/99.1, 99.2, 27.1, 294/31.1, 15, 16, 33, 103.1, 102.1, 100, 92, 86.4; 446/296, 308, 472, 473, 268

[56] References Cited

U.S. PATENT DOCUMENTS

| | | | |
|---|---|---|---|
| 552,171 | 12/1895 | Farnham . | |
| 1,139,942 | 5/1915 | Wightman et al. . | |
| 1,325,885 | 12/1919 | Weber . | |
| 1,701,057 | 2/1929 | Thatcher . | |
| 1,766,478 | 6/1930 | Baker et al. . | |
| 2,231,637 | 2/1941 | Ramos . | |
| 2,244,072 | 6/1941 | Ledbetter . | |
| 2,284,029 | 5/1942 | Welling . | |
| 2,356,722 | 8/1944 | Harris . | |
| 2,456,445 | 12/1948 | Rees et al. . | |
| 2,600,771 | 6/1952 | Hofmann . | |
| 3,151,346 | 10/1964 | Gray . | |
| 3,365,227 | 1/1968 | Wildgen | 294/27.1 |
| 3,503,546 | 3/1970 | Hunt . | |
| 3,653,708 | 4/1972 | Merola | 294/99.1 |
| 3,735,426 | 5/1973 | Horvath . | |
| 3,942,194 | 3/1976 | Winter . | |
| 4,021,866 | 5/1977 | Wasko . | |
| 4,148,424 | 4/1979 | Fortenberry . | |
| 4,273,275 | 6/1981 | Vadnais . | |
| 4,463,879 | 8/1984 | Des Voignes . | |
| 4,606,484 | 8/1986 | Winter et al. . | |

*Primary Examiner*—James B. Marbert

*Attorney, Agent, or Firm*—Willian Brinks Olds Hofer Gilson & Lione Ltd.

[57] ABSTRACT

A gripping device for a doll's extremity has a holder, resilient material retained in the holder, and a handle. An object is pushed into a slot defined by the resilient material. The resilient material grasps the object and retains it in the holder. The handle is integral with the holder and allows the gripping device to be attached to a doll's extremity, such as a hand. This gives an observer the impression that the doll is actually holding the object.

15 Claims, 1 Drawing Sheet

FIG. 1
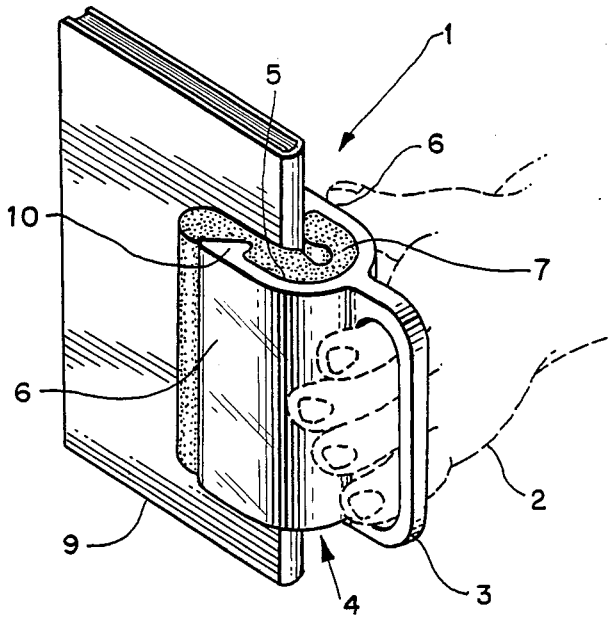
FIG. 2
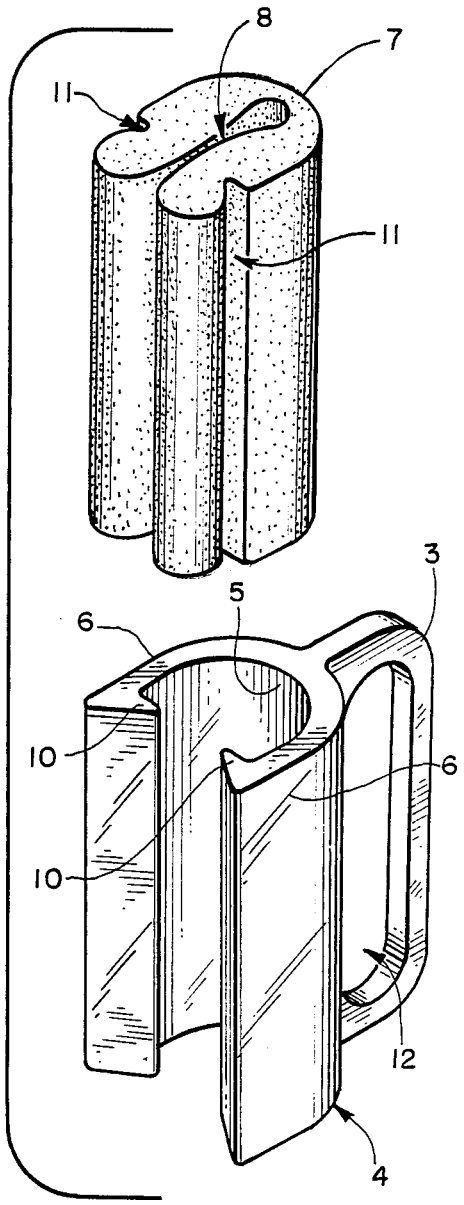
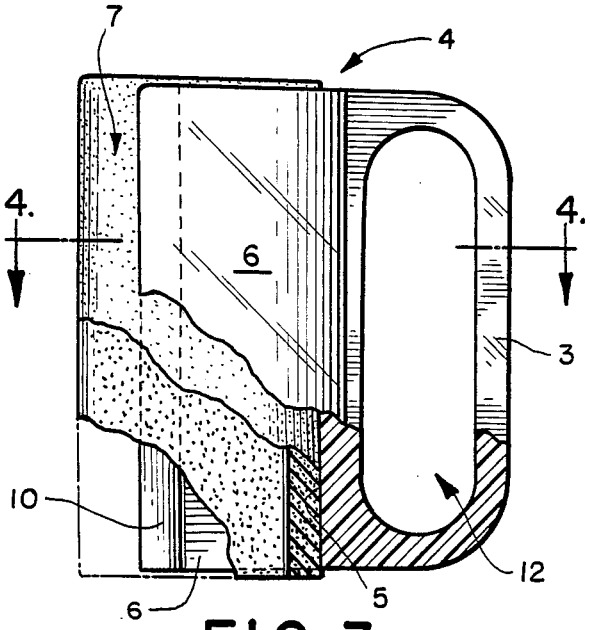
FIG. 3
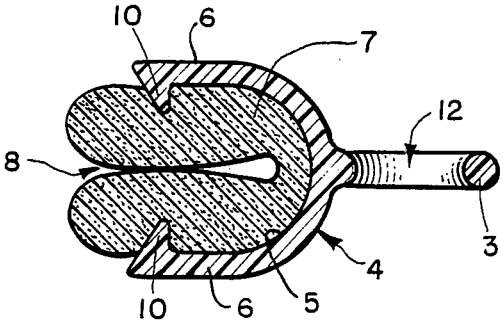
FIG. 4
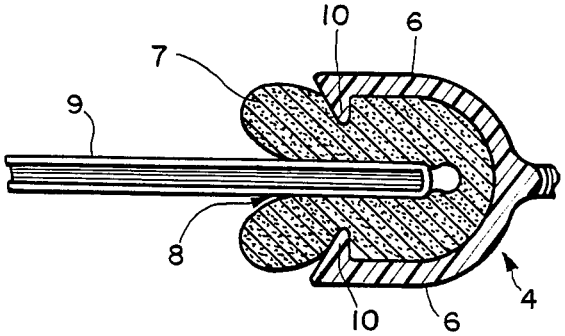
FIG. 5

GRIPPING DEVICE FOR A DOLL'S EXTREMITY

BACKGROUND OF THE INVENTION

This invention relates to gripping devices for holding objects and particularly to gripping devices suitable for attachment to a doll.

The aesthetic quality of a doll is enhanced by displaying the doll in an active pose. Posing a doll to simulate activities such as reading a book or combing hair stirs the imagination of the observer and provides a more pleasing effect.

The creation of active poses usually requires that the doll interact with some other object. The present invention creates the impression of such interaction by simulating the holding of objects by a doll.

SUMMARY OF THE INVENTION

The present invention is directed to an improved gripping device for attachment to an extremity of a doll.

Generally, the present invention relates to a gripping device for a doll which includes a holder. A resilient grasping means is retained in the holder and is used to grasp at least a portion of an object. The gripping device also includes an attaching means for attaching the holder to the doll.

BRIEF DESCRIPTION OF THE DRAWINGS

FIG. 1 is a perspective view of the gripping device of the preferred embodiment grasping an object and engaging a doll's hand.

FIG. 2 shows an exploded view of the gripping device shown in FIG. 1.

FIG. 3 shows a side sectional view of the gripping device shown in FIG. 1.

FIG. 4 is a cross sectional view taken along line 4—4 of FIG. 3.

FIG. 5 is an overhead view of a portion of the gripping device of FIG. 1 grasping an object.

DETAILED DESCRIPTION OF THE PRESENTLY PREFERRED EMBODIMENT

Referring now to the drawings, FIG. 1 shows a preferred embodiment of the invention in the form of a gripping device generally indicated by reference numeral 1. The gripping device 1 includes a holder 4 which is constructed of a rigid material, preferably acrylic. As shown in FIGS. 4 and 5, the holder 4 has a U-shaped cross section, and includes two opposing side walls 6. As best seen in FIG. 2, ridges 10 are integral with the side walls 6 and run the length of each side wall 6.

The holder 4 holds a resilient material 7, which is preferably a resilient silicone rubber. The resilient material 7 is formed to conform to the interior surface 5 of the holder 4 and thus fits tightly within the holder 4. In addition, the resilient material 7 has grooves 11 that run the length of the resilient material 7. As shown in FIGS. 2, 4 and 5, these grooves 11 engage the ridges 10 when the gripping device 1 is assembled. The resilient material 7 is retained in the holder 4 by the friction created by the tight fit of the resilient material 7 in the holder 4, and the engagement of the ridges 10 by the grooves 11. The resilient material 7 is shaped to define a slot 8 which runs the entire length of the holder 4.

The gripping device 1 also includes a handle 3 for attaching the gripping device 1 to the doll's hand 2. As best seen in FIG. 3, the handle 3 is integral with the holder 4 and has an aperture 12. FIG. 1 shows the handle 3 receiving the doll's hand 2 through the aperture 12.

As shown in FIGS. 1 and 5, the slot 8 is formed to receive a portion of an object, such as a toy book 9. An insertion force is applied to the object to push the object into the slot 8. The object may be inserted perpendicular to, as well as parallel to, the ridges 10 of the holder 4. Since the gripping device 1 can receive objects from a plurality of directions, a wide variety of objects can be gripped.

As the slot 8 receives the object 9, the resilient material 7 is compressed between the object 9 and at least a portion of the interior surface 5 of the holder 4. When the resilient material 7 is compressed, a grasping force is created by the resilient material 7 against the object 9. This force is sufficiently great to retain the object 9 within the holder 4 when the insertion force has ceased.

Of course, it should be understood that various changes and modifications to the preferred embodiment described herein will be apparent to those skilled in the art. For example, the resilient material 7 may be of a foam rubber instead of a silicone rubber or the holder 4 may be constructed of a metallic material. Such changes and modifications can be made without departing from the scope of the present invention and without diminishing its attendant advantages. It is, therefore, intended that such changes and modifications be covered by the following claims.

I claim:

1. A device, attachable to a hand of a doll, for gripping an object comprising:

a holder including first and second ridges;

a handle attached to said holder, said handle defining an opening for receiving at least a portion of said hand of said doll;

a resilient material defining first and second grooves, said first and second grooves engaging said first and second ridges, respectively; and said resilient material defining a slot for receiving at least a portion of said object;

wherein said object is gripped by said resilient material as said object is inserted into said slot.

2. The device of claim 1 wherein said first and second grooves of said resilient material are engaged by said first and second ridges, respectively, such that a portion of said resilient material crosses a plane defined as extending between said first ridge and said second ridge.

3. The device of claim 2 wherein said holder has a U-shaped cross section.

4. The device of claim 3 wherein said resilient material is silicone rubber.

5. The device of claim 4 wherein said resilient material is foam rubber.

6. A device, attachable to a hand of a doll, for gripping an object comprising:

a holder having a U-shaped cross section, said holder defining an interior surface and an outer surface;

first and second ridges integral with said inner surface of said holder;

a handle, integral with said outer surface of said holder, said handle defining an opening for receiving at least a portion of said hand of said doll;

a resilient material defining first and second grooves, said first and second grooves engaging said first and second ridges, respectively;

said resilient material defining a slot for receiving at least a portion of said object;

wherein said resilient material grips said object when said object is inserted into said slot.

7. The device of claim 6 wherein said first and second grooves of said resilient material are engaged by said first and second ridges, respectively, such that a portion of said resilient material crosses a plane defined as extending between said first ridge and said second ridge.

8. The device of claim 7 wherein said holder has a U-shaped cross section.

9. The device of claim 8 wherein said resilient material is silicone rubber.

10. The device of claim 9 wherein said resilient material is foam rubber.

11. A device for gripping an object, said device attachable to a hand of a doll to simulate the holding of said object by said doll, said device comprising:

a holder including first and second ridges;

a handle attached to said holder, said handle defining an opening for receiving at least a portion of said hand of said doll;

a resilient material defining first and second grooves, said first and second grooves engaging said first and second ridges, respectively; and said resilient material defining a slot for receiving at least a portion of said object;

wherein said object is gripped by said resilient material as said object is inserted into said slot.

12. The device of claim 11 wherein said first and second grooves of said resilient material are engaged by said first and second ridges, respectively, such that a portion of said resilient material crosses a plane defined as extending between said first ridge and said second ridge.

13. The device of claim 12 wherein said holder has a U-shaped cross section.

14. The device of claim 13 wherein said resilient material is silicone rubber.

15. The device of claim 14 wherein said resilient material is foam rubber.

* * * * *